US005593089A

United States Patent [19]

Coomer et al.

[11] Patent Number: 5,593,089

[45] Date of Patent: Jan. 14, 1997

[54] CROSSTIE PLUG FOR A RAILROAD SPIKE

[76] Inventors: Ralph L. Coomer, 3969 Flat Lick Rd., Mount Washington, Ky. 40047; Charles L. Stalker, Rte. 2, 550 Thompson La., Bloomfield, Ky. 40008; Joseph T. Wilson, 506 Maplecrest Dr., LaGrange, Ky. 40031

[21] Appl. No.: 542,991

[22] Filed: Oct. 13, 1995

[51] Int. Cl.[6] ..... E01B 9/06

[52] U.S. Cl. ..... 238/370; 238/371; 411/22; 411/30; 411/59

[58] Field of Search ..... 238/366, 370, 238/371; 411/21, 22, 25, 30, 31, 44, 59, 448

[56] References Cited

U.S. PATENT DOCUMENTS

| | | | |
|---|---|---|---|
| 977,795 | 12/1910 | Gronke et al. . | |
| 995,503 | 6/1911 | Wakefield . | |
| 1,035,419 | 8/1912 | Clark . | |
| 1,133,947 | 3/1915 | Fischer . | |
| 1,263,665 | 4/1918 | Harsh . | |
| 1,294,778 | 2/1919 | Cutting . | |
| 1,407,999 | 2/1922 | Harbis . | |
| 1,774,968 | 12/1930 | Gorrell et al. . | |
| 1,855,329 | 4/1932 | Wagner . | |
| 2,719,452 | 10/1955 | Jones . | |
| 2,728,120 | 12/1955 | Snyder | 238/370 |
| 3,396,624 | 8/1968 | Eriksson et al. . | |
| 3,865,307 | 2/1975 | Schiro | 238/366 |
| 3,964,680 | 6/1976 | Arthur | 238/366 |
| 4,134,546 | 1/1979 | Dankert | 238/370 |
| 4,203,193 | 5/1980 | Arthur | 238/366 |

*Primary Examiner*—S. Joseph Morano
*Attorney, Agent, or Firm*—Wheat, Camoriano, Smith & Beres, PLC

[57] ABSTRACT

A railroad crosstie plug is positioned within an existing spike hole in a crosstie to restore a predetermined gage between parallel railroad rails. The plug comprises a hollow sleeve having a slot along one side thereof and an interior configuration complimentary to the configuration of the spike. A member separate from the sleeve is pivotally mounted at one end to a lower edge of the slot. The member also defines an impact surface extending across a portion of the interior of the sleeve. When a spike is forced into the sleeve against the impact surface, a second end of the member pivots out of the sleeve and into the surrounding wood of the railroad tie there by locking the sleeve and spike in place within the hole.

17 Claims, 5 Drawing Sheets

CROSSTIE PLUG FOR A RAILROAD SPIKE

BACKGROUND OF THE INVENTION

This invention relates to devices for the fastening of a railroad rail to a crosstie or sleeper and, more specifically, relates to devices for permitting the refastening of a railroad rail to a crosstie using an existing spike hole in a crosstie after extended use thereof.

The modern railroad rail has a flat bottom and its cross-section is much like an inverted T. The rails are fastened in pairs, in a spaced apart and parallel relationship to sleepers or crossties with spikes of steel. While historically, the cross sections of rails have varied greatly, there is a strong movement today to standardize both the length and weight of the rail. An accepted length is about 39 feet with a weight of about 136 pounds. Rails are typically laid in lengths and joined end to end by fishplates or joint bars. The rails may be fastened directly to the crossties but it is generally preferred, particularly in heavy traffic areas, to use a tie plate that seats a rail such that the weight is distributed over a greater area of the crosstie. The preferred fastener is the off-set head spike although there are other fasteners at higher cost that may be used.

The cross ties have been traditionally wood treated with a preservative chemical to extend the life of the crosstie which may approach 35 years. The rising cost of wood has made the concrete crosstie more economically attractive but wood still remains by far the preferred material. One of the more important developments in railroad track has been the use of welded rail sometimes as long as ¼ mile. Temperature expansion has not been as large a problem as thought. Control of the expansion is accomplished in part by extensive anchoring of the rail to the crosstie through use of heavy ballast to prevent the rail from moving.

The tracks are laid down in parallel with the distance between the inner faces of the parallel rails being called gage. It is important that this gage be maintained with some exactness since too large a gage causes vibration and rough riding and in the most severe conditions leads to disrailment. Because of the continuous force being exerted outwardly by the wheels of trains using a track, a significant force is exerted periodically against the crossties by the railroad spikes away from the centerline of the track formed by the rails. This periodic force causes the hole made by the spike when driven into the tie to become progressively larger, particularly accentuated at the top of the opening of the hole. Left unattended, the spikes will tend to retrograde out of the hole and/or lean into the widening hole under pressure of a train moving over the rails thereby widening the gage of the track beyond acceptable limits.

Many attempts have been made to solve the problems of spike retrograde and gage change of railroad tracks. Complicated, and consequently much more expensive, spike structures have been offered to provide increased anchorage into the wood of the crossties and to prevent retrograde movement of the spike and minimize the effect of the hole widening. A very earlier attempt is illustrated by U.S. Pat. No. 977,795 which uses an off-set spike having an elongated central cavity running the length thereof adapted to receive a removable pin. Once the spike is pounded into the tie, the pin is then forced into the cavity and causes a pair of teethed members to pivot out of the body of the spike into the surrounding wood of the crosstie. The spike cannot move since it is anchored by the pivoting members against retrograde movement. Variations of this type of spike can be found in U.S. Pat. Nos. 1,035,419, 1,113,947, and 3,865,307. Such spikes, however, have not proved to be commercially attractive due to the significant manufacturing costs.

Other attempts have been made using an insert which is driven into the hole along with the spike. The insert is typically expandable or provided with a series of spikes that prevent the insert and spike from moving out of the hole. Examples of the insert solution to the problem are found in U.S. Pat. Nos. 1,294,778, 1,774,968, 3,964,680, and 4,203,193. While the inserts may address the retrograde movement of the spikes, the widening gage problem remains a serious consideration.

The problem of widening gage has been largely addressed by removing the crosstie, replugging the hole, repositioning the rails to the proper gage, and then driving a spike into the crosstie. If the gage widening is significant, the entire crosstie is discarded. Clearly neither technique is desirable as both are costly. Moreover, discarding crossties before the life expectancy of the wood is reached is an environmentally unsound technique unless the crossties can be used for other and different purposes.

Thus, it is a paramount object of the present invention to provide for a device that permits gage of a track to be restored to its proper value after a period of use while reusing the crossties. It is another important object of the present invention to provide for a device permitting the use of a crosstie for a period of time approximating its normal wear life at a cost which is less than the replacement of the crosstie with a new one.

These and other objects will become readily apparent upon a reading of the description herein with the appended drawings.

SUMMARY OF THE INVENTION

The present invention pertains to a hole plugging device that can utilize the existing and enlarged spike holes hole made by train traffic along the rails to restore the proper gage. The plugging device is adapted to be forced into the existing spike hole in a crosstie and comprises a sleeve having a substantially hollow interior, essentially complementary to the external configuration of a railroad spike and a slot along one side of the sleeve. The side having the slot is oriented so that it faces the enlarged portion of the hole when inserted therein. Associated with the sleeve is an anchoring member that pivots from an initial position in response to a spike being inserted into the sleeve interior to an extended position when the spike is fully positioned within the sleeve. In the initial position, the anchoring member is housed completely within the sleeve so as not to obstruct insertion of the sleeve into the existing spike hole. In the extended position, however, the anchoring member is almost substantially positioned outside of the sleeve but is firmly seated at the bottom thereof against the lower edge of the slot and has one end that penetrates into the crosstie.

DETAILED DESCRIPTION OF THE PREFERRED EMBODIMENT

Figure 1:
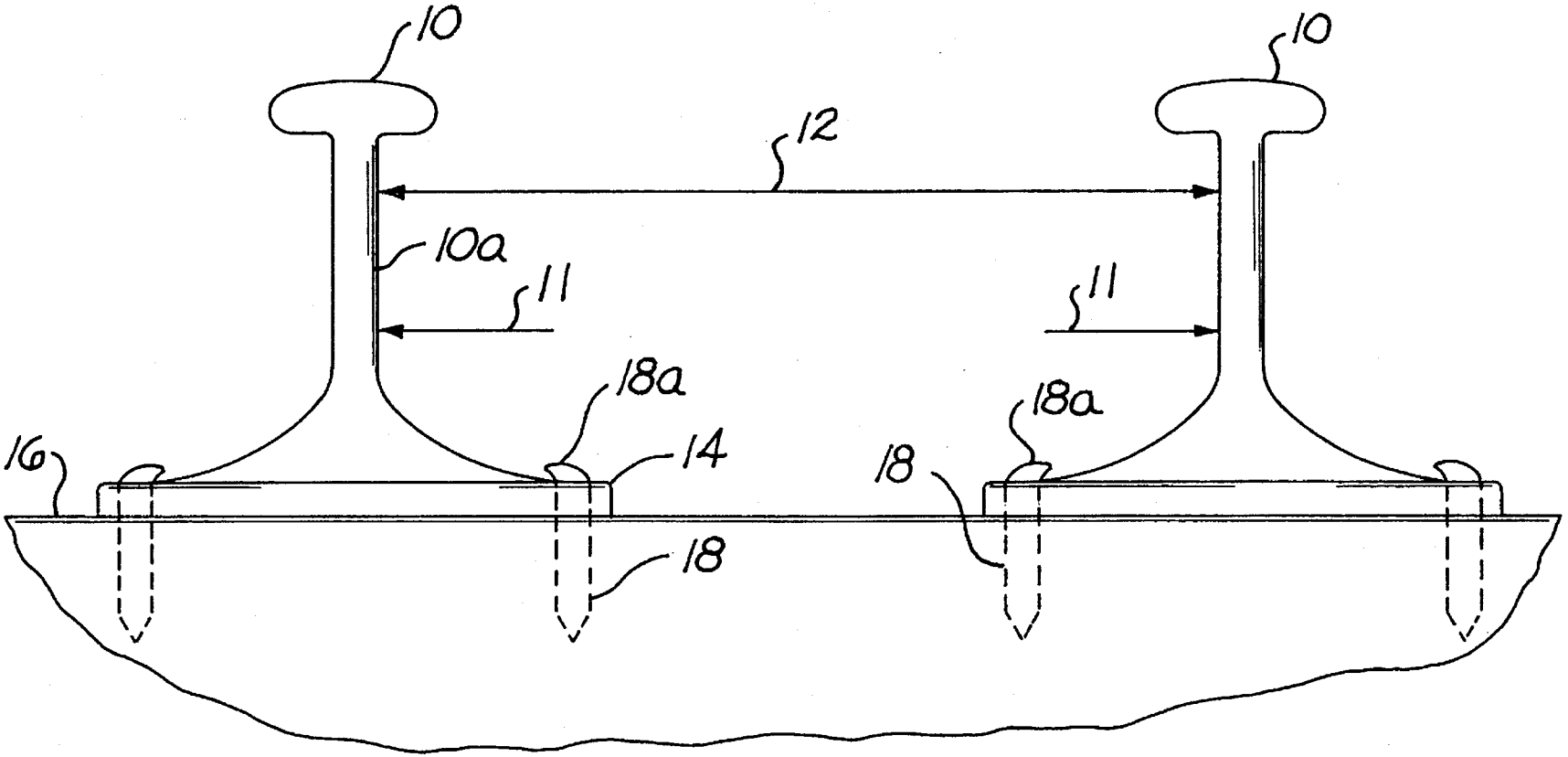
PRIOR ART FIG. 1
FIG. 1 is a side elevation view of a typical railroad track showing a pair of rails, tie plates, spikes and crosstie.

Reference is first made to FIG. 1 showing a pair of railroad rails 10 positioned a predetermined distance apart setting the track gage shown by arrow 12. Gage is measured from the inside facing surfaces 10*a* of the rails 10. Each rail 10 is positioned in a tie plate 14 abutting a crosstie 16. An off-set head spike 18 is then driven through holes in the tie plates 14 located on either side of the rails 10 and into the crosstie 16. The off-set head 18*a* then tightly secures the rails 10 to the tie plates 14 and cross-tie 16.

Figure 2:
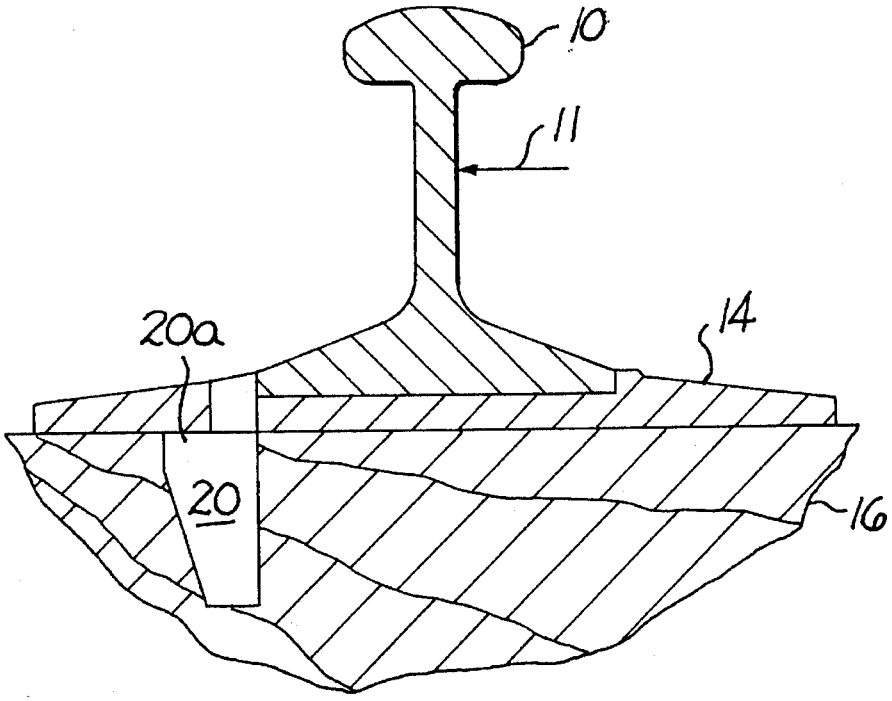
PRIOR ART FIG. 2
FIG. 2 is side section view of a rail without the spike, tie plate, and crosstie, depicting an enlarged spike hole due to wear.

The forces of passing trains, however, cause the gage to widen due to movement of the spike and tie plate in the "outboard direction" away from the center of the track. The spike 18 on the outboard side is caused to wear into the wood providing a hole 20 in crosstie 16 having a top circumference larger that the bottom. This is best seen in FIG. 2 in which the spike has been removed from the hole. The outboard force is shown by arrow 11. Over a period of time, the force exerted against the spike causes it to lean in the direction of the force and causing a widening of the hole in the wooden crosstie along the upper portion 20*a*. Thus, the entire rail 10 tends to move in that direction causing the gage to widen.

Figure 3:
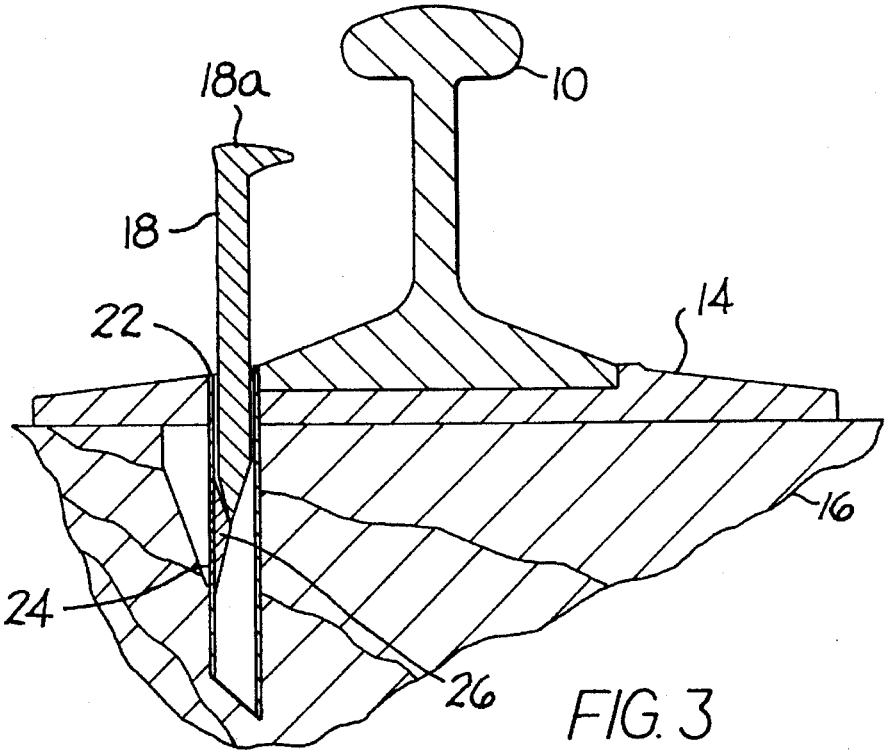
FIG. 3 is a side sectional view of a rail and associated fastening elements showing a plugging device of the present invention in place in the existing crosstie hole with a spike initially being inserted into a sleeve of the plugging device.
Figure 6:
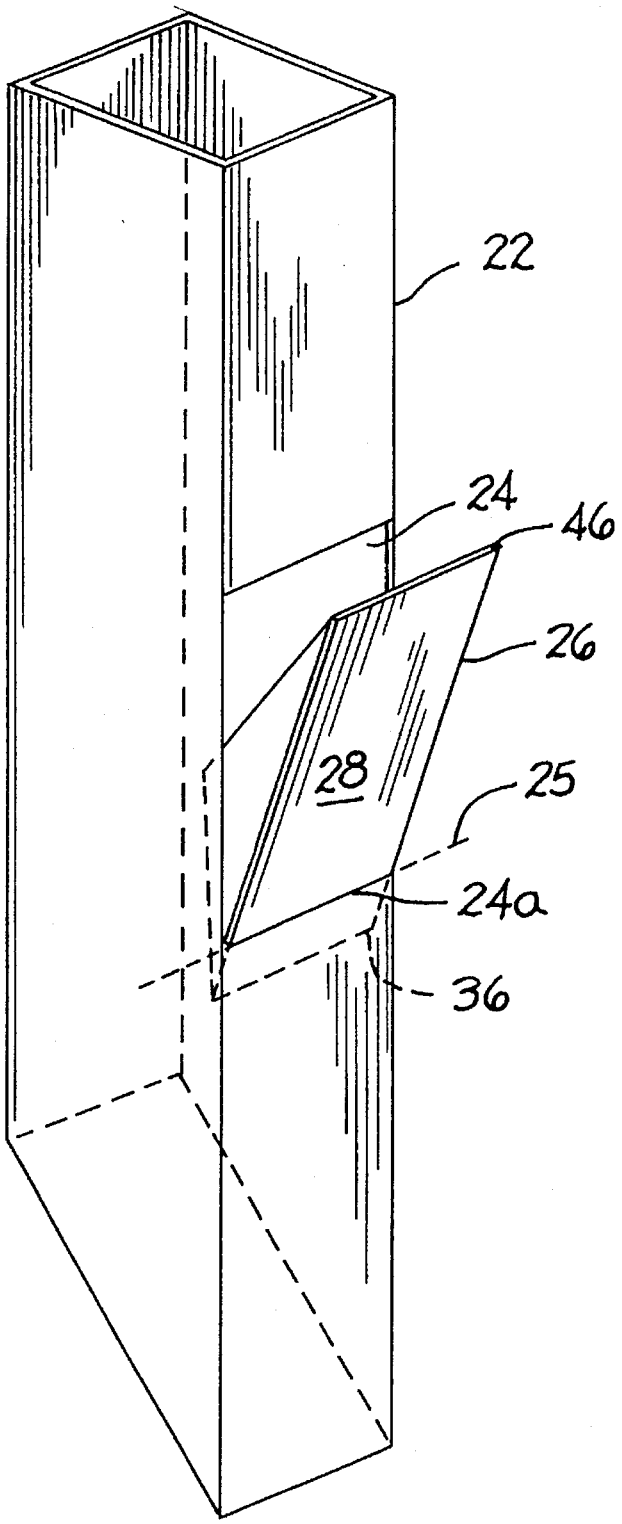
FIG. 6 is a perspective view of the sleeve of the plugging device of the present invention with the movable component being in an extended position.

To remedy the above problem, the rails are removed and, in accordance with the present invention, a steel sleeve 22 having a slot 24 as defined by side 30, as more clearly illustrated in FIG. 6, is driven into the hole 20 with the slot 24 facing the widened portion 20*a*. The initial positioning of the sleeve 22 within opening 20 is shown in FIG. 3. Sleeve 22 may be beveled along its lower end to facilitate penetration into the wood at the bottom of hole 20. The interior circumference of sleeve 22 is complimentary to the typically rectangular section of a railroad spike and is adapted to receive a spike in a snug fitting relationship.

Figure 7:
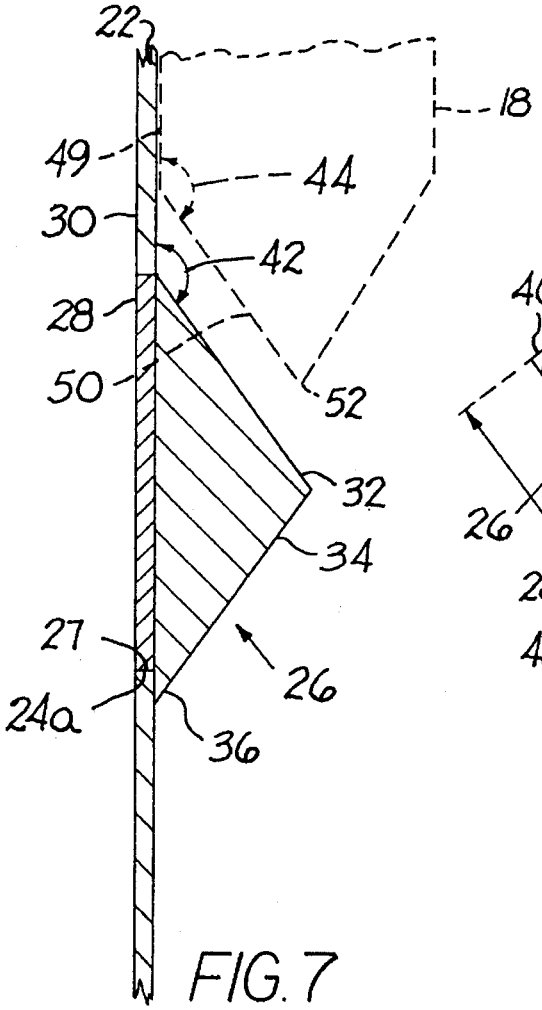
FIG. 7 is a side sectional view showing a portion of the wall of the sleeve containing a slot and the movable component in its initial position within the sleeve.
Figure 9:
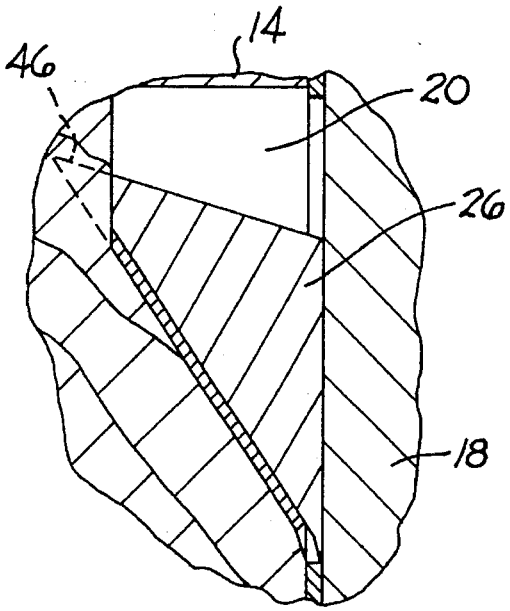
FIG. 9 is an expanded view of a portion of FIG. 5 showing the distal end of the movable member being driven into the wood of the crosstie.

A pyramidally shaped member 26 with three major operative surfaces is mounted in a pivotable relationship to the sleeve 22 adjacent the bottom edge 24*a* of the slot 24. The member 26 has a width and length substantially the same as the width and length of slot 24 so as to be able to pivot therethrough, allowing only a frictional clearance between side walls of member 26 (FIGS. 6 and 9) and the edges of slot 24. In an initial position, member 26 is housed substantially within the sleeve 22 and an outward facing surface 28 is essentially congruent to the surface area defined by the slot 24 and thus positioned essentially co-planar with the outside surface of side 30 of sleeve 22. The surface 28 is "framed" within the perimeter of slot 24. The co-planar relationship is best illustrated in FIG. 7. In the same initial position, a second surface 32 of member 26 extends downwardly and partially across the interior of sleeve 22 as shown in FIG. 7. A third surface 34 extends downwardly from surface 32 and toward side 30 and terminates below the slot edge 24*a*. The extension of surface 34 below slot 24, shown by character numeral 36, is closely positioned to or in an abutting relationship with the interior surface 40 of side 30. Thus, a bottom edge 27 of member 26 is seated against the slot edge 24*a* that serves as a pivot axis for member 26. It should be noted that in this preferred embodiment, member 26 is not directly connected to the sleeve 22. This is an important consideration since a direct pivot connection would be subjected to significant forces and would likely increase the probability of structural failure.

Referring again initially to FIG. 3, it may be seen that upon entry into sleeve 22, the tip of spike 18 does not directly contact the surface of the member 26. This is an important consideration since it is desirable that the spike not "dig" into the surface 32 of member 26 to avoid breakage of member 26. Referring now to FIG. 7, it may be seen that surface 32 forms an "exterior" slope angle 42 with the interior wall 40 of side 30. To prevent digging, it is desired that the surface 32 have a slope steep enough to prevent the spike point from impacting against surface. As is clearly seen, a "spike head" angle 44 is formed between a side 49 of the spike shank and a converging side 50 that forms the point 52 of the spike 18. To prevent digging, it has been noted that by making the exterior slope angle 42 equal to or slightly greater than the spike head angle 44, digging is largely eliminated without sacrificing the required impact surface needed to pivot member 26 from its initial position within sleeve 22 to its extended position.

Figure 4:
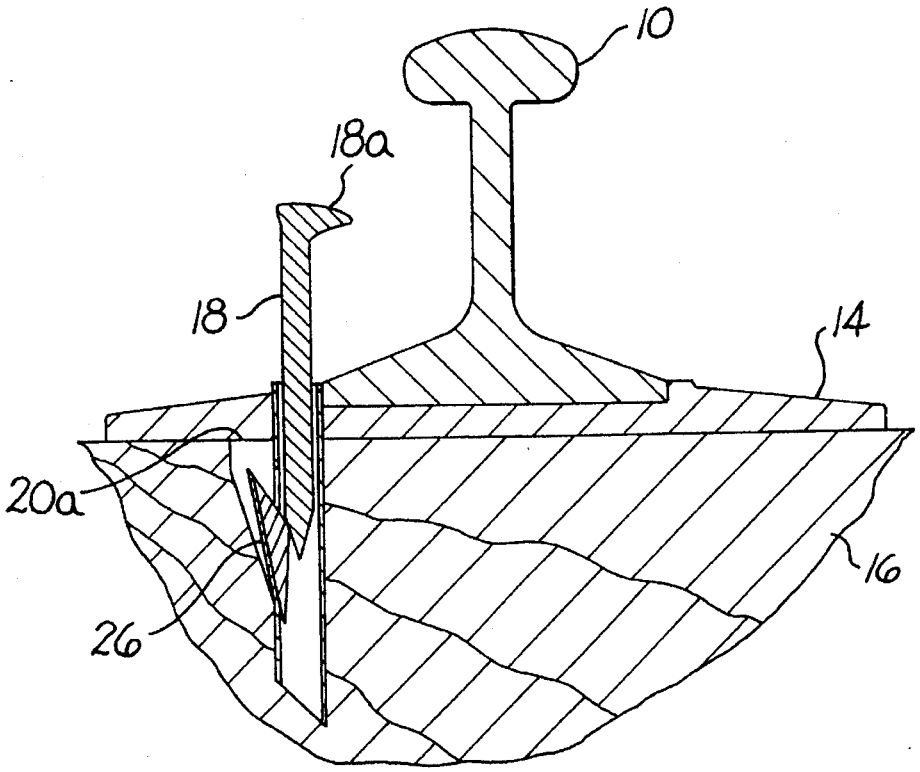
FIG. 4 is a side sectional view identical to FIG. 3 except the spike has been inserted further into the sleeve and has engaged a movable component of the plugging device.
Figure 5:
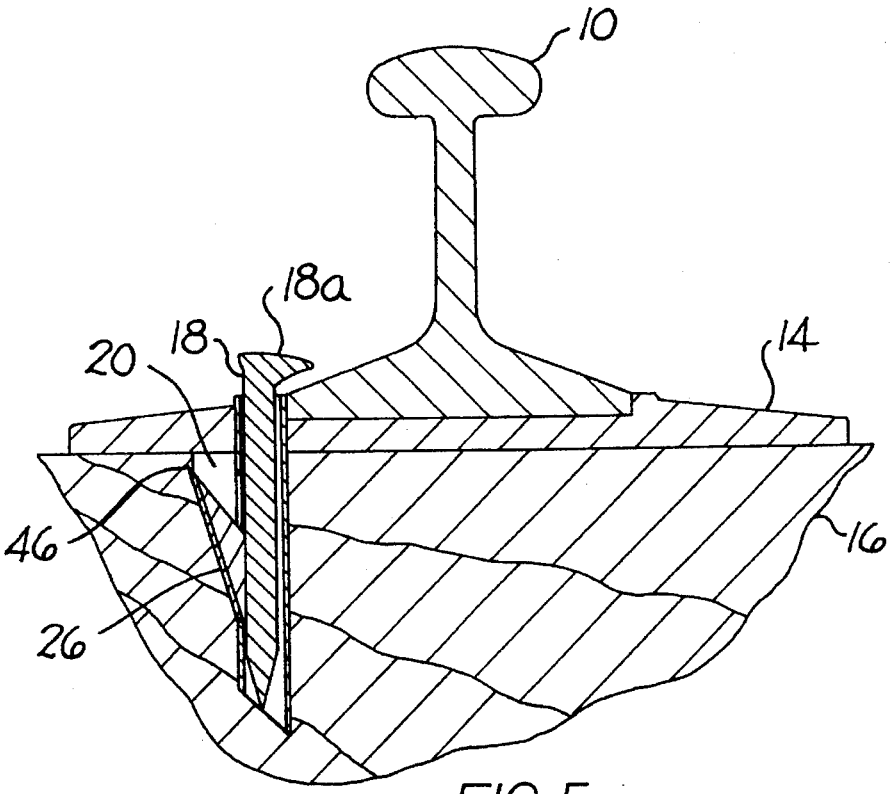
FIG. 5 is a side sectional view identical to FIG. 3 except the spike has been completely inserted into the sleeve and the movable component has penetrated into the wood of the crosstie.
Figure 8:
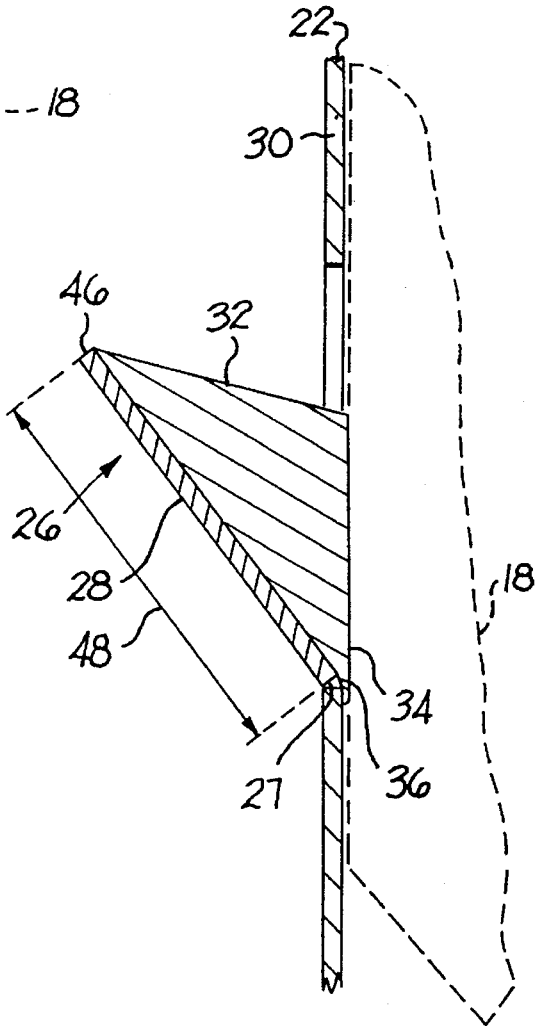
FIG. 8 is identical to the view of FIG. 7 except the movable component is shown in the extended position.

As the spike 18 is driven into the impact surface 32 of the member 26, the resultant force causes member 26 to swing out through slot 24 about a pivot axis 25 (shown in dashed lines in FIG. 6) that is coextensive with slot edge 24*a*. The progression of pivoting of member 26 is illustrated by FIGS. 3–5. As the spike 18 is driven past member 26, it tightly abuts wall 34 and causes surface 34 to be aligned essentially parallel to the exterior surface of side 30. Extension 36 is bent and crushed to abut against the inside surface of side 30 (as shown in FIG. 8), and assists member 26 in securing sleeve 22 in place. The distal end 46 of member 26, formed by the conversion of surfaces 28 and 32, is forced into the wood of the surrounding crosstie 16 through the mechanical advantage provided by the wedge action of spike 18 against surface 32 as illustrated in FIG. 5 and the expanded view of FIG. 9.

While member 26 may be fabricated from any material that will provide sufficient stiffness and strength to both penetrate the wood of the crosstie, the bending of the extension as set forth above, and to thereafter prevent retrograde movement of the sleeve, member, and spike out of the crosstie under normal wear conditions, it has been found that metallic materials such as steel or aluminum or certain alloys are preferred. Dimensionally, the size of member 26 is limited only by the size of the sleeve 22 and the size of the slot 24. It has been noted, however, that the depth into which the apex or distal end 46 penetrates the wood of the crosstie depends to a large extent on the length 48 (shown in FIG. 8) of surface 28. For a penetration of about ¾ inch, it has been found that length of surface 28 of member 26 should be slightly less than about 2¾ inches to permit the traversing of the distal end 46 from its initial position across hole 20 to the wood of crosstie 16.

Thus, when member 26 is in the extended position as shown in FIG. 5, member 26 is firmly fixed to the crosstie 16, is in an abutting relationship with the spike 18, and has been driven against the sides of sleeve 22 by the spike 18. Spike 18 itself is tightly wedged in the confines of sleeve 22 and is firmly anchored within the crosstie as if it had been driven into new wood of crosstie 16. Moreover, since the outward movement of the distal end 46 of member 26 crosses the entire width of the widened hole 20, plugging of the hole is made completely unnecessary.

From a reading of the foregoing, it should be clear that the plugging device of the present invention can be rotated and used on either side of a railroad track. Additionally, if desired the plugging device could be constructed to have two anchoring members, each of which can pivot out through slots located on opposites sides of the sleeve. Other changes and modifications will become apparent to those with ordinary skill in the art. Thus, it is to be understood that only the preferred embodiment of the invention was disclosed, but it is understood that the such changes and modifications should be interpreted within the scope of the inventive concept as expressed herein.

We claim:

1. A railroad device, adapted to be positioned within an existing spike hole in a crosstie, for restoring a predetermined gage between parallel railroad rails comprising a sleeve having a slot along one side thereof, said sleeve further having a substantially hollow interior adapted to receive a railroad spike and having a configuration complimentary to the configuration of the spike;

a member pivotally associated with said sleeve at a first end for pivoting movement between an initial position, in which said member is housed substantially within said sleeve, through said slot to an extended position, in which said member is positioned substantially outside of said sleeve, said member in said extended position having a distal end projecting outwardly from said sleeve, said member having a first surface positioned adjacent to and extending along said slot from said first end toward a top edge of said slot when said member is in the initial position, a second surface positioned across a portion of the interior of said sleeve when said member is in the initial position and adapted to be contacted by an edge of the spike when being urged into said sleeve thereby causing said member to pivot into said extended position, and a third surface being aligned in an essentially parallel relationship with said one side of said sleeve when said member is in the extended position and adapted to abut against the spike when positioned in said sleeve.

2. The device of claim 1 in which said sleeve has a rectangular cross-section.

3. The device of claim 1 in which said first and second surfaces define said distal end.

4. The device of claim 1 in which said first surface is essentially contiguous to an outer surface of said sleeve when said member is in the initial position, said member having an extension extending downwardly in an essentially abutting relationship with an inner wall of said sleeve below said slot, said extension collectively with an edge of said slot defining a pivot axis about which said member pivots.

5. The device of claim 1 in which said sleeve has a beveled lower end to facilitate penetration into wood.

6. The device of claim 1 in which said member is pivotally associated with said sleeve along a lower edge of said first surface.

7. In combination with a pair of railroad tracks positioned on wooden crossties by a plurality of spikes, at least one sleeve positioned in a hole of a selected crosstie, said hole being enlarged in the direction away from said railroad tracks made by a spike forced outwardly by forces exerted against the railroad tracks and said spikes, said sleeve having a substantially hollow interior and an open top, said sleeve further having an interior configuration complimentary to the configuration of a spike to be inserted into said sleeve and having a side facing said hole defining a slot, a member pivotally associated with said sleeve at a first end for pivoting movement between an initial position, in which said member is housed substantially within said sleeve, through said slot to an extended position, in which said member is positioned substantially outside of said sleeve, said member in said extended position having a distal end projecting outwardly from said sleeve and penetrating into said crosstie, said member having a first surface positioned adjacent to and extending along said slot from said first end toward said top opening when said member is in the initial position, a second surface positioned across a portion of the interior of said sleeve when said member is in the initial position and when contacted by an edge of said spike being urged into said sleeve through said top opening causing said member to pivot into said extended position, and a third surface being aligned in an essentially parallel relationship with said slot defining side of said sleeve when said member is in the extended position and in an abutting relationship with said spike positioned in said sleeve.

8. The device of claim 7 in which said first and second surfaces define said distal end.

9. The device of claim 7 in which said first surface is essentially contiguous to said slot defining side of said sleeve when said member is in the initial position, said member having an extension extending downwardly in an essentially abutting relationship with an inner wall of said sleeve below said slot, said extension collectively with an edge of said slot defining a pivot axis about which said member pivots.

10. The device of claim 7 in which said sleeve has a beveled lower end to facilitate penetration into wood.

11. The device of claim 7 in which said member is pivotally associated with said sleeve along a lower edge of said first surface.

12. A plugging device for insertion into an existing railroad spike hole in a wooden crosstie comprising a hollow, open top sleeve having an internal configuration complimentary to the external configuration of a railroad spike to be inserted into said sleeve through said open top, said sleeve having one side defining a slot with a predetermined width and length, and a plug anchoring member juxtaposed to said slot and having a width and length essentially the same as said width and length of said slot, said anchoring member adapted to be pivoted between an initial position in which said sleeve may be inserted into said existing spike hole and an extended position in which an end of said plug anchoring member may penetrate wood of the crosstie into which said sleeve may be inserted, said anchoring member when in said initial position having (i) a first surface with an edge abutting a lower edge of said slot, said first surface framed by said slot and coplanarly aligned with said one side of said sleeve, (ii) a second surface diverging from said first surface and downwardly extending across at least a portion of said interior of said sleeve, and (iii) a flange extension downwardly extending below said slot lower edge and abutting an interior surface of said one sleeve side, said plug anchoring member pivoting about said lower edge of said slot through said slot in response to a railroad spike contacting said second surface.

13. The plugging device of claim 12 in which said second surface has an exterior angle defined as an angle formed between said interior surface and said second surface equal to or greater than a spike head angle defined as an angle formed by a first side of said spike and a second side of said spike extending from said first side and converging toward a spike point.

14. The plugging device of claim 12 in which said extension bends in response to the spike being inserted into said sleeve and abuts said interior surface below said slot edge when said anchor member is in said extended position.

15. The plugging device of claim 14 in which said extension defines a portion of a third surface downwardly converging toward said interior surface from said second surface when said anchoring member is in said initial position, said third surface being essentially framed by said slot and coplanar with said interior surface when said anchoring member is in said extended position.

16. In combination, a railroad spike having a predetermined cross-sectional configuration and a plug securing device adapted to be positioned within an existing spike hole of a wooden railroad crosstie, said spike hole having a upper circumference larger than the circumference of the spike in the wooden railroad crosstie, and for restoring a predetermined gage between parallel railroad tracks, said plug securing device comprising an elongated sleeve having an interior with a cross-sectional configuration substantially complimentary to said predetermined cross-sectional configuration, said sleeve having a side defining a slot, and a member separate from said sleeve having a first end, a second end that is pivotally connected to a lower edge of said slot, and a spike impacting surface extending between said first and second ends said member pivoting about said second end, in response to the spike impacting against said surface, between an initial position in which said spike impacting surface extends into the interior of said sleeve and said first end is aligned substantially with said side and an extended position in which said first end extends across the upper circumference of the spike hole in which said sleeve is positioned and contacts the wood of the crosstie.

17. The combination of claim 16 in which said spike has a predetermined spike head angle defined as an angle formed by a first side of said spike and a second side of said spike extending from said first side and converging toward a spike point, said spike impacting surface having an exterior angle defined as an angle formed between an interior surface of said sleeve side and said spike impacting surface, said exterior angle being equal to or greater than said spike head angle.

* * * * *